US008588625B2

(12) United States Patent
Okamoto

(10) Patent No.: US 8,588,625 B2
(45) Date of Patent: Nov. 19, 2013

(54) CONSUMABLES STORAGE CONTAINER, IMAGE FORMING APPARATUS, PROCESS CARTRIDGE, AND SERVICE CONTROL SYSTEM

(75) Inventor: Naoyuki Okamoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 272 days.

(21) Appl. No.: 12/929,962

(22) Filed: Feb. 28, 2011

(65) Prior Publication Data

US 2011/0211849 A1 Sep. 1, 2011

(30) Foreign Application Priority Data

Mar. 1, 2010 (JP) ..... 2010-044199

(51) Int. Cl.
*G03G 15/00* (2006.01)
*G03G 15/08* (2006.01)

(52) U.S. Cl.
USPC ..... 399/24; 399/90; 399/103; 399/106

(58) Field of Classification Search
USPC ..... 399/13, 24, 27, 103–106, 90
See application file for complete search history.

(56) References Cited

U.S. PATENT DOCUMENTS

| | | | | |
|---|---|---|---|---|
| 7,616,905 | B2 * | 11/2009 | Masubuchi | 399/12 |
| 7,809,287 | B2 * | 10/2010 | Okamura | 399/12 |
| 7,826,780 | B2 * | 11/2010 | Deguchi | 399/262 |
| 2002/0143893 | A1 * | 10/2002 | Nakazono et al. | 709/217 |
| 2005/0214000 | A1 | 9/2005 | Kojima et al. | |
| 2007/0052164 | A1 | 3/2007 | Watase et al. | |
| 2007/0057444 | A1 | 3/2007 | Sagawa et al. | |
| 2007/0246879 | A1 | 10/2007 | Sagawa et al. | |
| 2008/0001350 | A1 | 1/2008 | Okamoto et al. | |
| 2008/0038039 | A1 | 2/2008 | Watase et al. | |
| 2008/0226342 | A1 | 9/2008 | Deguchi | |
| 2009/0185846 | A1 | 7/2009 | Okamoto | |

FOREIGN PATENT DOCUMENTS

| | | |
|---|---|---|
| CN | 1673888 | 9/2005 |
| JP | 11-160977 | 6/1999 |
| JP | 11-338210 | 12/1999 |
| JP | 3083091 A | 9/2000 |
| JP | 2000-338778 | 12/2000 |
| JP | 2002-365897 | 12/2002 |
| JP | 2006178280 A | 7/2006 |

OTHER PUBLICATIONS

Chinese Office Action dated Sep. 27, 2012 issued in Chinese Application No. 201110050225.4.
Korean Office Action dated Dec. 6, 2012 issued in corresponding Korean Application No. 10-2011-0015861.
JP 2006-178280 (Abstract Only).
JP 11-231757 (Abstract Only).

(Continued)

*Primary Examiner* — David Gray
*Assistant Examiner* — Gregory H Curran
(74) *Attorney, Agent, or Firm* — Harness, Dickey & Pierce P.L.C.

(57) ABSTRACT

A consumables storage container has an opening through which consumables are supplied. The consumables storage container includes a seal detachably attached to the opening to seal the opening, a part ID storage disposed on the seal, and a positioning holder to position and hold the seal at a prescribed position where the part ID storage is readable after the opening is unsealed.

18 Claims, 6 Drawing Sheets

(56) References Cited

OTHER PUBLICATIONS

Office Action dated Jun. 12, 2012 issued in corresponding Korean Application No. 10-2011-0015861.

Korean Office Action dated May 24, 2013 issued in corresponding Korean Application No. 2011-0015861.

Chinese Office Action dated Sep. 17, 2013 for corresponding Chinese Patent Application No. 201110050225.4.

* cited by examiner

CONSUMABLES STORAGE CONTAINER, IMAGE FORMING APPARATUS, PROCESS CARTRIDGE, AND SERVICE CONTROL SYSTEM

CROSS-REFERENCE TO RELATED APPLICATIONS

This application claims priority pursuant to 35 USC §119 to Japanese Patent Application No. 2010-44199, filed on Mar. 1, 2010, the entire contents of which are hereby incorporated by reference herein.

BACKGROUND OF THE INVENTION

1. Field of the Invention

The present invention relates to a consumables storage container, an image forming apparatus, a process cartridge, and a service controlling system capable of precisely detecting unsealing of a seal that seals an opening of the consumables storage container at low cost without employing a large-scale mechanism while providing precise customer service control.

2. Description of the Background Art

In the past, an image forming apparatus employing an electrophotographic system, such as a copier, a printer, etc., includes a consumables storage container for containing consumables, such as toner, etc. Such a consumables storage container generally includes an opening for supplying and ejecting the consumables there from to a developing section, and is sealed by a seal when consumables storage container is stored with the consumables and is transported to a prescribed destination to avoid leakage thereof. A user then removes the seal when installing the consumables storage container in a body of the image forming apparatus. Such a consumables storage container is sometimes integrated with a developer container generally separately prepared into a single unit. Further, a developing device equipped with a consumables storage container and a developer container sometimes constitutes a process cartridge together with a photoconductive member serving as an image bearer, which is removably installed in the image forming apparatus. As described in Japanese Patent Application Laid Open No. 2006-178280 (JP-2006-178280-A), a process cartridge with an opening formed therein for supplying consumables from a consumables storage container to a developer section and sealed with a seal it is known, in which a fresh new process cartridge is unsealed when the process cartridge is installed in the image forming apparatus.

However, when such a conventional process cartridge is installed with the opening still sealed, the image forming apparatus cannot operate properly. Accordingly, a manner of precisely detecting removal of the seal at low cost has long been sought. However, when a user removes a seal after installing the consumables storage container to the image forming apparatus, a large-scale mechanical parts system is needed to automatically unseal the opening in the image forming apparatus. Such a large-scale mechanical assembly is not cost-effective in view of its single function of detecting the unsealing of the seal. Consequently, a technology capable of accurately detecting unsealing of the seal at low cost while maintaining precise customer service control is demanded.

Further, to accurately and precisely detect automatic unsealing of the seal at low cost, and to detect if a developer container with its opening being sealed is new or not, Japanese Patent No. 3083091 (JP-3083091-B) describes a developer container that is removably installed in a body of the image forming apparatus, containing developer with its opening sealed with a seal. Specifically, there are provided a seal base sealing the opening, a force reception section receiving an unsealing force applied to the seal base, and an electrically conductive section cut off by an action of unsealing the seal base. Further, to detect in an image forming apparatus if the conductive section is cut off or not, a contact point is provided in the conductive section to electrically connect with a contact point provided in the body of the image forming apparatus. Further disposed are a developing device employing the developer container with its opening being sealed, a process cartridge, and an image forming apparatus to which the developer container is removably installed.

However, JP-3083091-B again cannot offer precise customer service control and improved services at low cost.

SUMMARY OF THE PRESENT INVENTION

Accordingly, an object of the present invention is to address and resolve such and other problems and provide a new and novel consumables storage container that has an opening through which consumables are supplied. The consumables storage container further includes a seal detachably attached to the opening to seal the opening, a part ID storage disposed on the seal, and a positioning holder to position and hold the seal at a prescribed position where the part ID storage is readable after the opening is unsealed.

In one aspect, the part ID storage is composed of one of an IC and a bar code.

In another aspect, the seal positioning holder includes a positioning boss disposed on an external wall of the consumables storage container, a positioning hole formed on the seal, said positioning hole fitting to the positioning boss; and a adhering member to stick the seal to the external wall of the consumables storage container.

In yet another aspect, the seal positioning holder includes at least two holding pieces at a prescribed interval forming a gap almost corresponding to a thickness of the seal from the external wall.

In yet another aspect, a developing roller is provided in the developing container to develop an image with the consumables.

In yet another aspect, an image forming apparatus includes an image bear to bear a latent image, the above-described developing device to develop the latent image on the image bearer, a part ID reader to read information of the part ID storage included in the seal after the opening is unsealed.

In yet another aspect, the part ID storage adheres to a section of the seal other that facing the opening of the consumables storage container.

In yet another aspect, a process cartridge includes the above-described developing device, and one of a photoconductive member, a charging device, and a cleaner integrally supported with the developing device in a unit. The unit is removably installed in a body of an image forming apparatus.

In yet another aspect, the image forming apparatus including the process cartridge.

In yet another aspect, a service controlling system connecting the image forming apparatus to one of a maintenance division and a maintenance service station includes a part ID information transmitter to transmit part ID information read in the image forming apparatus from the image forming apparatus, and a part ID information receiver to receive the part ID information from the image forming apparatus. One of maintenance division and maintenance service station controls inventory of consumables based on the part ID information.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
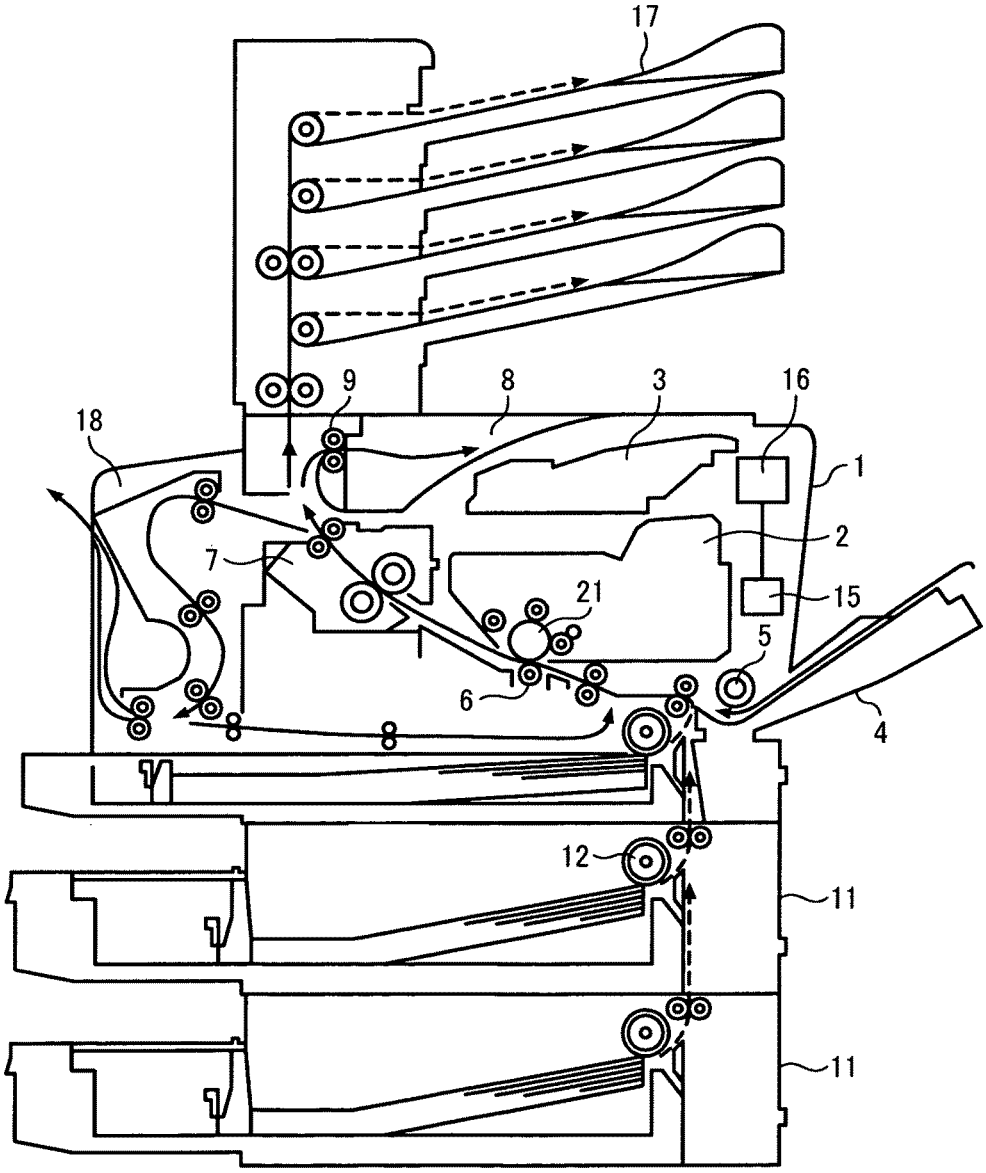
FIG. 1 schematically illustrates an exemplary image forming apparatus employing an electro-photographic system, in a body of which a process cartridge is disposed, according to one embodiment of the present invention.
Figure 2:
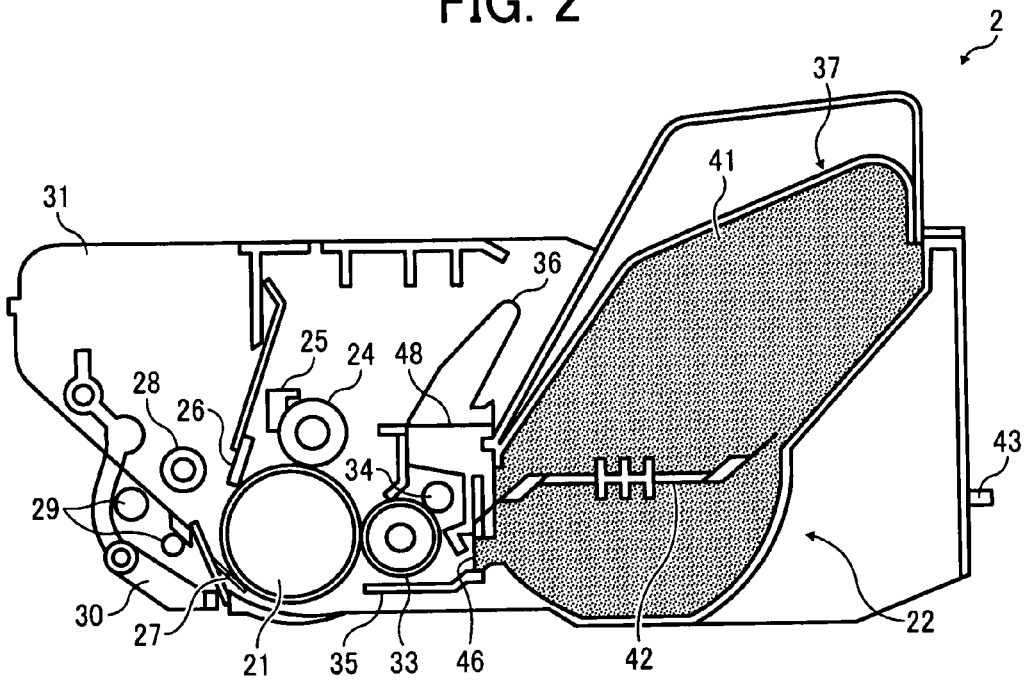
FIG. 2 schematically illustrates an exemplary configuration of the process

Referring now to the drawing, wherein like reference numerals designate identical or corresponding parts throughout the several views, in particular in FIGS. 1 and 2, an exemplary image forming apparatus employs an electro-photographic system, in a body of which a process cartridge is disposed. The process cartridge includes a consumables storage container having an opening thereon for supplying consumables to an outside with its being sealed by a seal. Further, a piece of part ID information is added to the seal. A seal holder is uniquely disposed at a prescribed position on the consumables storage container to hold the seal, so that the seal is not separated from the consumables storage container, even when the opening is unsealed as described later in various embodiments more in detail.

Figure 3:
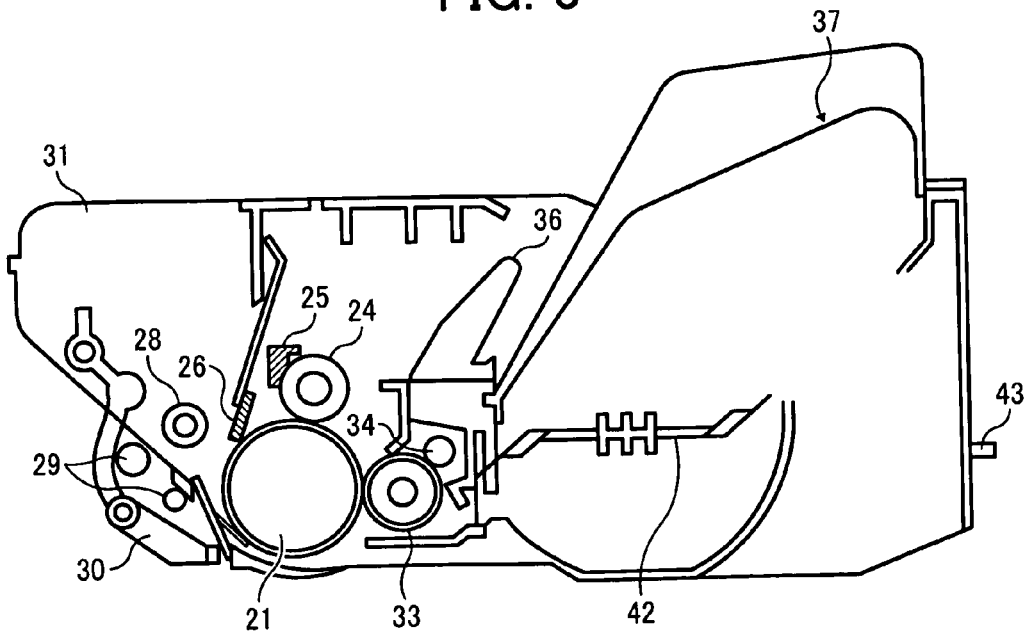
FIG. 3 schematically illustrates an exemplary configuration of the process cartridge including the toner cartridge that does not contain toner.

Now, an exemplary image forming apparatus, such as a copier, a printer, a laser printer, etc., employing an electro-photographic system, and a consumables storage container (a process cartridge) disposed in the image forming apparatus are described with ref to FIGS. 1 to 3.

Initially, an exemplary configuration of an image forming apparatus 1 is described with ref to FIG. 1. As shown, the image forming apparatus 1 has an openably closable cover, not shown, and is enabled to accommodate a removably attachable process cartridge 2 when the cover is opened. An optical device 3 is disposed above the process cartridge 2 in the drawing. A multiple tray 4 is disposed on the right side in an apparatus body. A sheet feeding roller 5 is disposed on the left side of the multiple trays 4. A transfer roller 6 is disposed below the process cartridge 2. A fixing device 7 is disposed on the left side of the transfer roller 6. A sheet ejection tray 8 and a sheet ejection roller 9 are disposed above the fixing device 7. A sheet feeding cassette 11 and a sheet feeding roller 12 are disposed in a lower section of the image forming apparatus to executed cassette sheet feeding.

15 denotes a part ID information reader disposed in the vicinity of the process cartridge 2 to read part ID information identifying the process cartridge 2. Specifically, as described later, the part ID information reader 15 reads part ID information stored in an IC or a bar code attached or put to the seal as part ID information storage when the seal is drawn and held on the external wall of the process cartridge 2. 16 denotes a part ID information transmitter connected to the part ID information reader 15 and transmits necessary information to an outside of the image forming apparatus based on the information read from the part ID information in a manner as described later in detail. Further, 17 and 18 denote a print post and a duplex unit, respectively.

As shown in FIGS. 2 and 3, the process cartridge 2 is integrally composed of a photoconductive drum 21 driven and rotated as an image bearer and a developing device 22 or the like as a unit. There are disposed, around the photoconductive drum 21, a charge roller 24, a charge roller use cleaning blade 25, a photoconductive drum use cleaning blade 26, and a separation pick or the like. 28, 29, 30, and 31 denote a consumables collection roller, a spur, a photoconductive drum shutter, and a consumables storage container, respectively.

The developing device 22 includes a developer container 36 and a toner cartridge 37 beside a developing roller 33 for bearing developer and a developing casing 35 including a stirring roller 34 or the like. As described later, the developer container 36 and the developing casing 35 are communicated with each other. The toner cartridge 37 and the developing casing 35 are also communicated with each other. 41 denotes toner as consumables. 42 denotes an agitator. 43 denotes a positioning used boss disposed on an external wall of the process cartridge 2 to position the same.

Now, an exemplary operation of an image forming apparatus is described with ref to FIGS. 1 to 3. The surface of the photoconductive drum 21 of the process cartridge 2 is uniformly charged by the charge roller 24. When an optical device 3 emits a laser light on to the surface of the photoconductive drum 21 in accordance with an original image, a latent image is similarly formed thereon. The latent image on the photoconductive drum 21 is then developed and visualized by toner included in developer conveyed by a developing roller 33 disposed in the developing device 22.

The respective multiple tray and sheet feeding cassette may feed sheets one by one in cooperation with the sheet feeding rollers 5 and 12. The thus launched recording medium as the sheet passes thru the gap between the photoconductive drum 21 and the transfer roller 6 to be subjected to a transfer process in which a toner image is transferred thereon from the photoconductive drum 21. The recording medium with the transferred toner is then conveyed to the fixing device 7 and is subjected to a fixing process in which the toner image is fixed thereonto by heat and pressure. The recording medium is then ejected onto the sheet ejection tray 8 disposed on the outside thereof.

In the above-described process, the toner stored in the toner consumables storage container 37 of the process cartridge 2 is consumed per image formation.

Figure 4A:
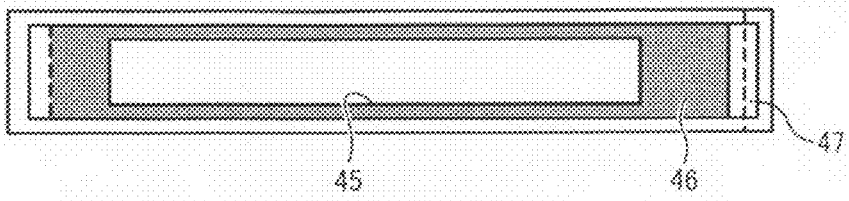
FIGS. 4A and 4B are front and cross sectional plan views, respectively, which collectively illustrate an exemplary relation between a seal and an opening.
Figure 4B:
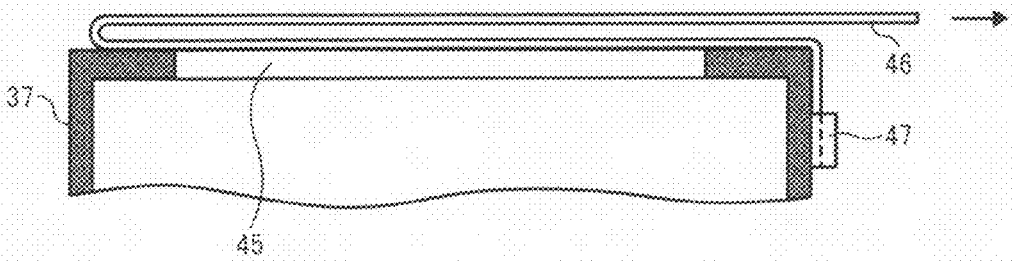

Now, an exemplary sealing mechanism is described with ref to FIG. 4A. As shown, a laterally extending rectangular shaped opening 45 is formed on a partition wall disposed at a boundary between the developing casing 35 including the developing roller 33 and the toner cartridge 37 on the left side thereof. The rectangular shaped opening 45 is sealed with a seal 46. Specifically, there is disposed a adhesive margin on an outer circumferential edge section around the rectangular shaped opening 45, so that the seal adheres thereto to prevent leakage of toner therefrom and thereby contamination in an inside of a machine during transportation of the process cartridge 2.

Figure 5A:
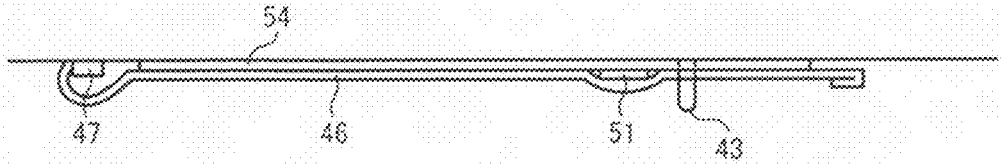
FIGS. 5A and 5B are cross sectional plan and front views, respectively, which collectively illustrate an exemplary condition where the seal drawn from the process cartridge is positioned and held at a prescribed place on an external wall of the process cartridge.
Figure 5B:
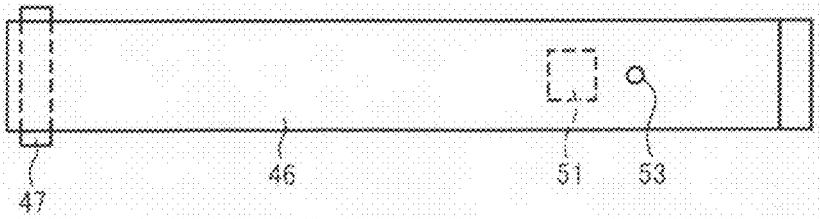
Figure 8:
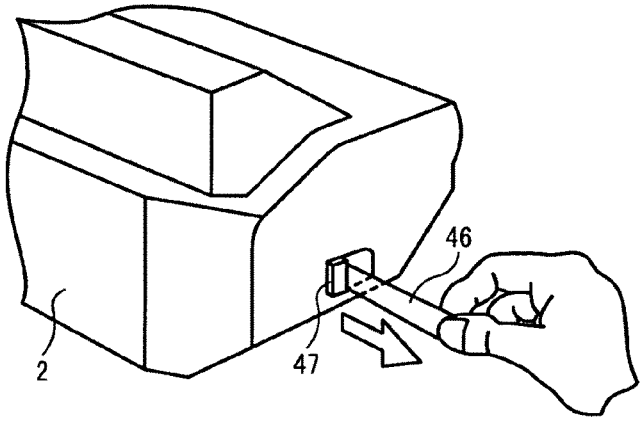
FIG. 8 is a perspective view illustrating an exemplary aspect when the seal is drawn from the process cartridge.

One end of the seal 46 firmly connects the external wall of the toner cartridge 37 using a fixing member 47 that does not separate even when receiving a normal force, and entirely covers over the rectangular shaped opening 45. Further, as shown in FIG. 5, the seal 46 is folded into two at its lengthwise center with it other end protruding from the process cartridge 2 to be freely drawn outside as shown in FIG. 8. Thus, when the other end of the seal 46 is picked and is drawn in a direction shown by an arrow in the drawing, the seal is gradually peeled off and the opening 45 is unsealed. When the opening 45 is unsealed, the toner cartridge 37 and the developing casing 35 are communicated with each other, and the toner stored in the toner cartridge 37 is supplied to the developing casing 35, so that image formation becomes available.

Further, back to FIG. 2, the developer container 36 of the process cartridge 2 also stores two component developer having carrier and toner. A boundary between the developing casing 35 and the developer container 36 is sealed by a (second) seal 48 as similar in the toner cartridge 37. Thus, when the second seal 48 is removed, the developing casing 35 and the developer container 36 are communicated with each other, so that the developer in the developer container 36 can be supplied to the developing casing 35.

Figure 6:
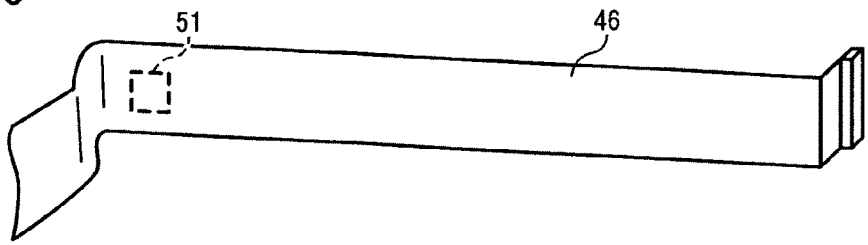
FIG. 6 schematically illustrates an exemplary seal having an IC as part ID info storage.

Now, a first embodiment of a seal 46 is described more in detail. The seal 46 may be a heat seal film made of PP (polypropylene) and PE (polyethylene) having a thickness of from about 70 to about 140 micron. Specifically, the outer circumference of the seal 46 adheres around the opening with heat energy, so that the seal 46 is hardly torn and finely removed therefrom. As shown in FIG. 6, a widely recently available IC 51 is attached to the seal 46 as part ID information storage, storing part ID information, such as a lot number of toner, that of parts, a manufacturing date, etc., of a process cartridge. For example, an RFID (Radio Frequency Identification) manufactured by Mitsubishi Co, Ltd. may be used as the IC 51 among those manufactured by others.

Figure 9:
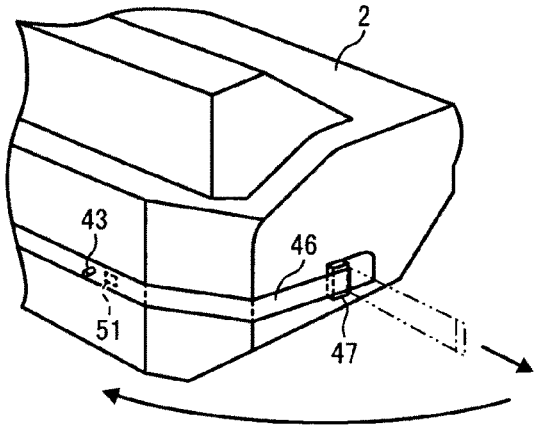
FIG. 9 is a perspective view illustrating an exemplary aspect when the seal drawn from the process cartridge is positioned and held on the external wall of the process cartridge.
Figure 10:
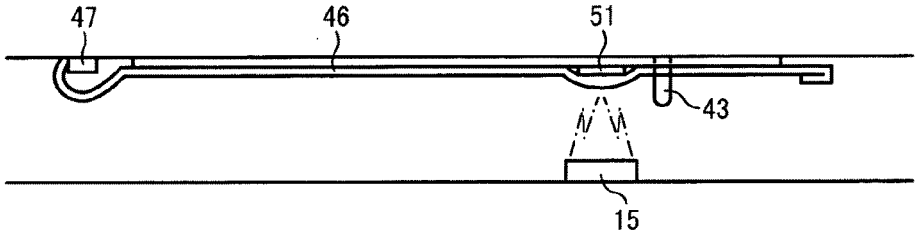
FIG. 10 illustrates an exemplary aspect when the seal is positioned and held on the external wall of the process cartridge and an IC faces a part ID information reader.

A positioning opening 53 is disposed on a seal 46 to fit to the positioning use boss 43 disposed on the external wall of the process cartridge 2. These positioning opening 53 and the positioning use boss 43 collectively constitute a positioning and holding system to position and hold the seal 46 in corporation with adhering member 54 when it is peeled off and positioned and held on the external wall of the process cartridge 2. Since one end of it connects to the external wall of the process cartridge 2 with the fixing member 47, the seal 46 comes to stop and does not move any more when drawn by a prescribed length. Then, as shown in FIGS. 5 and 9, the positioning opening 53 of the seal 46 is fit to the positioning boss while the seal 46 adheres to the external wall of the process cartridge 2 via the adhering member 54. Consequently, a distance between the IC 51 on the seal 46 and the parts ID information reader 15 on the side of the image forming apparatus comes to permit wireless transmission, so that the parts ID information stored in the IC 51 can be read by the part ID information reader 15. The above-described adhering member 54 may be previously adhesively attached onto the rear surface of the seal 46 or is separately prepared therefrom.

Figure 13:
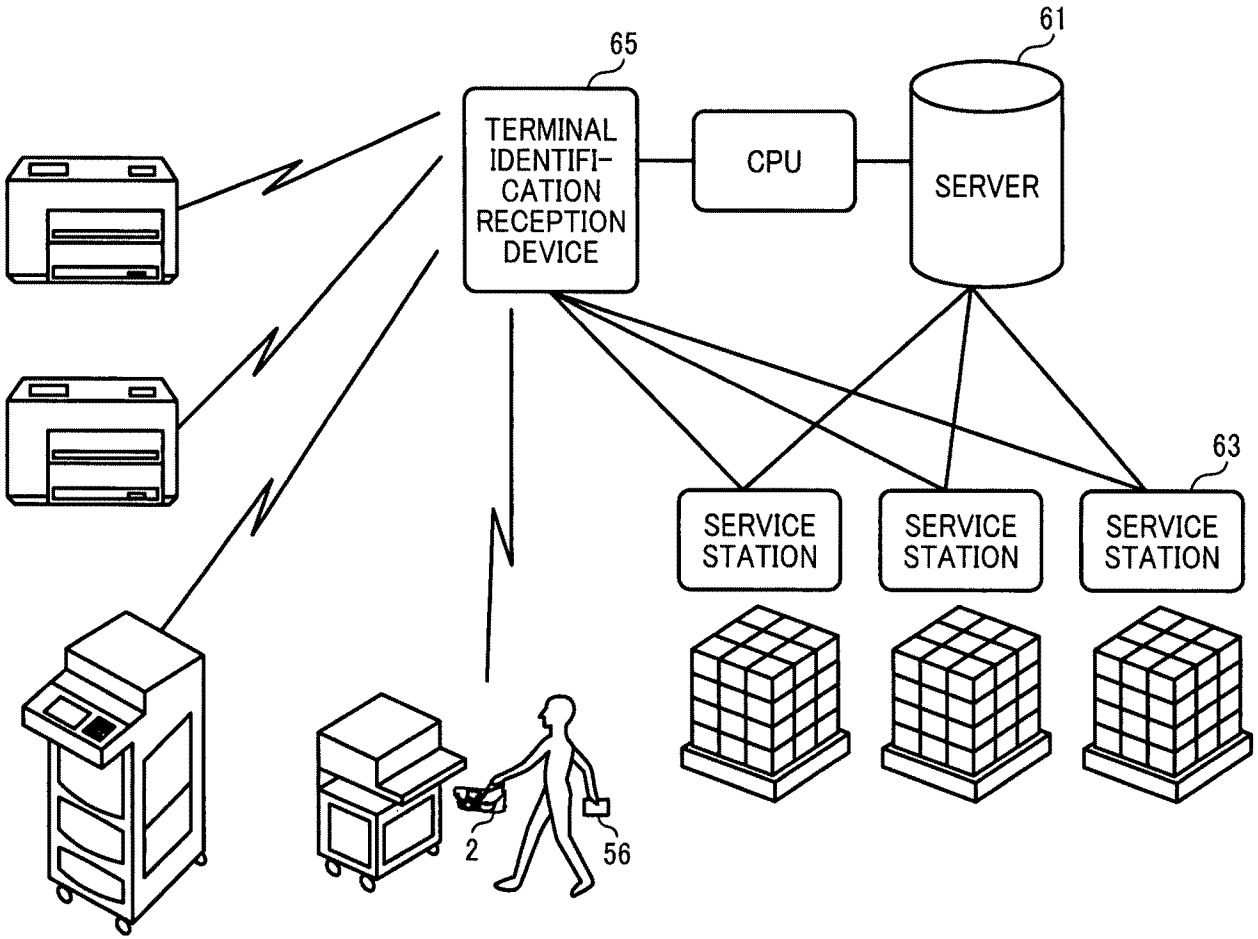
FIG. 13 schematically illustrates an exemplary service controlling system according to one embodiment of the present invention.

The part ID information reader 15 includes a wireless communication member capable of communicating with the IC 51. Thus, the part ID information reader 15 reads and transmits the part ID information stored in the IC 51 to the part ID information transmitter 16 disposed in the apparatus body 1 (see FIG. 1). Subsequently, as shown in FIG. 13, the part ID information transmitter 16 transmits the part ID information to either a server 61 disposed in a service division that maintains image forming apparatus and the like or to an part ID information receiver 65 connected to each of service stations 63 via the network. Such a part ID information transmitter 16 and a part ID information receiver 65 can be established by communications system capable of communicating signals over a computer network.

Thus, by receiving and obtaining information with the part ID information reader 65 of the above-described system, each of the service stations can monitor a lot number of each of parts used in a process cartridge 2 of the image forming apparatus, and an amt of usage of those in a region in charge based thereon. As a result, each of the service stations can recognize a life time and a number of the process cartridges 2 with consumables being closely used up in the charging region. Accordingly, each of the service stations can always maintain inventory of the process cartridges 2 and thereby enabling to provide careful services with appropriate maintenance.

Figure 7A:
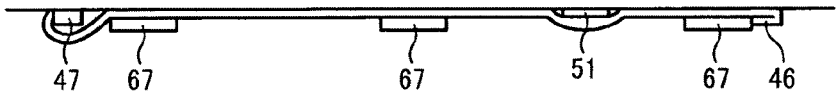
FIGS. 7A and 7B are cross sectional plan and front views, respectively, which collectively illustrate another exemplary seal drawn from the process cartridge and is positioned and held at a prescribed position on the external wall of the process cartridge.
Figure 7B:
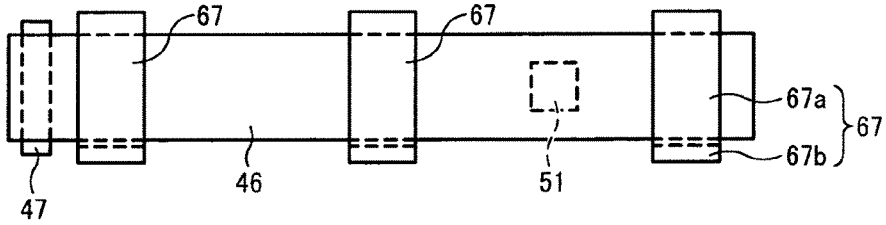

Now, another exemplary positioning holder for positioning and holding a seal 46 is described with ref to FIG. 7. As shown, plural holder pieces 67 are disposed in a longitudinal direction of the seal 46 on the external wall of the process cartridge 2. The holder piece 67 has an L-shaped cross section, and is composed of a body piece 67*a* and a bottom piece 67*b* each in a rectangular shape.

The holder piece 67 connects to the external wall of the process cartridge 2 via the bottom piece 67*b* while firming a gap almost corresponding to a thickness of the seal due to the bottom piece 67*b*. In this way, the seal 46 is held by the holder piece 67.

Figure 11:
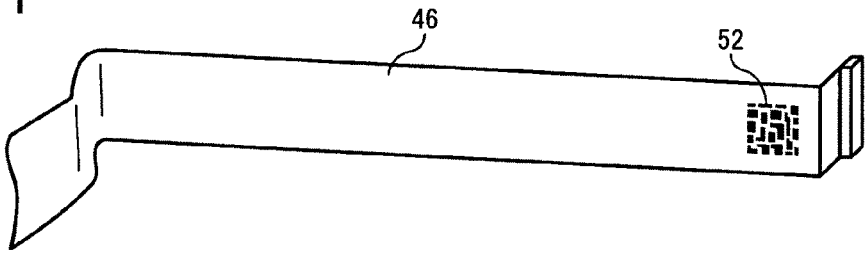
FIG. 11 illustrates another exemplary seal with a bar code thereon as part ID information storage.
Figure 12:
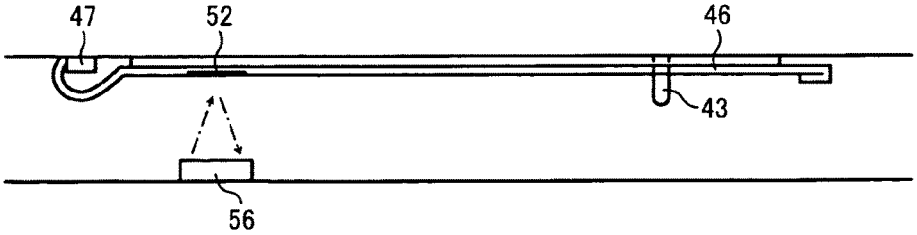
FIG. 12 illustrates an exemplary aspect when the seal is positioned and held on the external wall of the process cartridge and the bar code faces the part ID information reader.

Now, a second embodiment is described with ref to FIG. 11. As shown, a bar code is printed on the seal 46 as part ID information storage. A bar code reader 56 is also disposed at a prescribed position in the apparatus body 1 to read the part ID information when the process cartridge 2 is installed in the apparatus body, and the bar code is brought to a prescribed position by the positioning boss. Specifically, since a machine cover is opened every when the process cartridge is installed in the machine (image forming apparatus body), if a result of detection of opening thereof is utilized to activate light emission of the bar code reader 56 or the like, the bar code can be read. Even though an amt of part ID information thereof is limited less than that of the IC 51, the information can be handled at low cost.

Now, a third embodiment is described, in which the above-described part ID information reader is omitted in the machine (and disposed in any other location). Specifically, a process cartridge increasingly comes to be recycled considering impact on environment, recently. Therefore, if the part ID information, such as manufacturing date, etc., is known based on the IC 51 or the bar code, a usage amt can be roughly known. Consequently, it is readily determined if parts can be further used or replaced with new. Accordingly, such information is useful these days.

Further, the above described seal 48 can similarly include part ID information storage to monitor the developer container 3.

Numerous additional modifications and variations of the present invention are possible in latent image of the above teachings. It is therefore to be understood that within the scope of the appended claims, the present invention may be practiced otherwise that as specifically described herein.

What is claimed is:

1. A consumables storage container, comprising:

an opening through which consumables are supplied to an exterior of the consumables storage container;

a seal releasably attachable to the opening to seal the opening;

a part ID storage disposed on the seal; and a positioning holder to position and hold the seal at a prescribed position where the part ID storage is readable after the opening is unsealed, wherein one end of the seal is attached to an external wall of the consumables storage container when the seal is released.

2. The consumables storage container as claimed in claim 1, wherein said part ID storage is composed of one of an IC and a bar code.

3. The consumables storage container as claimed in claim 1, wherein said seal positioning holder includes:

a positioning boss disposed on the external wall of the consumables storage container;

a positioning hole formed on the seal, said positioning hole fitting to the positioning boss; and an adhering member to adhere the seal to the external wall of the consumables storage container.

4. The consumables storage container as claimed in claim 1, wherein said seal positioning holder includes at least two holding pieces at a prescribed interval apart, said at least two holding pieces forming a gap almost corresponding substantially to a thickness of the seal from the external wall.

5. The consumables storage container as claimed in claim 4, wherein the at least two holding pieces has an L-shaped cross section.

6. The consumables storage container as claimed in claim 4, wherein the seal positioning holder is composed of a body piece and a bottom piece each in a rectangular shape.

7. The consumables storage container as claimed in claim 6, wherein the seal positioning holder is connected to the external wall of the consumables storage container via the bottom piece.

8. A service controlling system connecting the image forming apparatus as claimed in claim 1 to one of a maintenance division and a maintenance service station, said service controlling system comprising:

a part ID information transmitter to transmit part ID information read in the image forming apparatus from the image forming apparatus; and a part ID information receiver to receive the part ID information from the image forming apparatus, wherein said one of maintenance division and maintenance service station controls an inventory of consumables based on the part ID information.

9. The consumables storage container as claimed in claim 1, wherein the one end of the seal is attached to the external wall of the consumables storage container using a fixing member.

10. The consumables storage container as claimed in claim 9, wherein the fixing member is attached to a sidewall of the consumables storage container.

11. The consumables storage container as claimed in claim 1, wherein the seal is folded into two at its longitudinal center.

12. The consumables storage container as claimed in claim 1, wherein the seal is adhered on an outer circumferential edge section around the opening.

13. The consumables storage container as claimed in claim 1, wherein the opening has a rectangular shaped opening.

14. An image forming apparatus, comprising:

an image bearer to bear a latent image;

a developing device to develop the latent image on the image bearer, and a part ID reader to read part ID information stored in a part ID storage included on a seal after an opening is unsealed, wherein one end of the seal is attached to an external wall of the consumables storage container when the seal is released.

15. The image forming apparatus as claimed in claim 14, further including a process cartridge integrally holding at least the image bearer and the developing device.

16. The image forming apparatus as claimed in claim 15, wherein said process cartridge further includes one of a photoconductive member, a charging device, and a cleaner integrally supported with the developing device in a single unit, wherein said unit is removably installed in an image forming apparatus.

17. The image forming apparatus as claimed in claim 14, wherein said part ID storage is disposed on a region of the seal other than a section that oppositely faces the opening of a consumables storage container.

18. The image forming apparatus as claimed in claim 14, wherein said developing device includes at least a developing roller to develop an image with consumables.

* * * * *